United States Patent [19]

McDonough

[11] 4,428,493

[45] * Jan. 31, 1984

[54] MULTIPLE SECTION WASTEBASKET AND THE LIKE

[76] Inventor: Suellen McDonough, 16 Meserve St., Durham, N.H. 03824

[ * ] Notice: The portion of the term of this patent subsequent to Mar. 16, 1990 has been disclaimed.

[21] Appl. No.: 872,031

[22] Filed: Jan. 25, 1978

Related U.S. Application Data

[63] Continuation of Ser. No. 666,892, Mar. 15, 1976, abandoned.

[51] Int. Cl.[3] ..... B65D 21/02; B65D 1/24

[52] U.S. Cl. ..... 220/20; 206/518; 206/519; 220/403

[58] Field of Search ..... 206/515, 518, 519, 520; 220/20, 22 L, 23.6

[56] References Cited

U.S. PATENT DOCUMENTS

| | | | |
|---|---|---|---|
| D. 239,156 | 3/1978 | McDonough | D7/187 |
| 2,896,809 | 7/1959 | Metzger | 220/23.6 |
| 2,974,819 | 3/1961 | Mevelle | 220/23.6 |
| 3,463,353 | 8/1969 | Peebles | 206/518 |
| 3,702,346 | 3/1973 | Cypher | 220/1 T |

*Primary Examiner*—George E. Lowrance

[57] ABSTRACT

This disclosure is concerned with a novel shape of compartmentalized wastebasket and the like utilizing inverted V-shaped separator walls and rather critically dimensioned to enable not only adequate post molding cooling for immediate stacking, but very close stacking for efficient storage despite relatively thick walls, and with ready adaptability for simultaneous multiple compartment use with conventional disposable paper and plastic bag inserts are the like that may be peripherally folded over the compartment top edges to keep them open during filling.

1 Claim, 2 Drawing Figures

MULTIPLE SECTION WASTEBASKET AND THE LIKE

This is a continuation application of Ser. No. 666,892, filed Mar. 15, 1976, now abandoned.

The present invention relates to wastebaskets and similar containers, being more particularly concerned with baskets having multiple compartments for enabling the collection of greater quantities of waste or other materials than is conventionally provided in the normal wastebaskets and the like used for many years in homes, offices and other locations.

Heretofore, efforts to provide useful sizes of wastebaskets and similar containers have been confined to manufacturing conventional cylindrical, frusto-conical, rectangular close-fitting or stackable shapes readily fabricated from metal and the like, and within the past decades from polyvinyl chloride, polystyrene, polyethylene and other moldable plastics. In general, the shaping and storage of such containeers in the manufacture and marketing phases has been readily feasible, particularly for such tapering cross-section structures, merely by successive insertions.

While compartmentalized containers have heretofore been constructed for various purposes, they have generally not been adaptable to close-fitting stacking and storing and, indeed, have not been particularly suitable for the insertion of paper or plastic bags as disposable liners the upper edges of which may be folded over the upper periphery of the containers to maintain them open until it is desired to remove the waste-filled bag.

It is to the solution of the problem of providing a readily and closely stackable multiple-compartmented waste basket construction void of the above disadvantages, that the present invention is accordingly primarily directed.

A further object is to provide a new and improved multiple compartment waste container and the like of more general use, as well.

Other and further objects will be explained hereinafter and are more particularly delineated in the appended claims.

In summary, the invention further contemplates a multiple-compartment closely stackable wastebasket and the like having, in combination, a generally rectangular container interiorly transversely compartmented by inverted V-shaped separator walls into three substantially similar substantially trapazoidal-walled compartments, the transverse separator walls extending upward an appreciable portion of the height of the container such that the end compartments are provided with transverse end walls of greater height than the intermediate compartment transverse end walls formed by the said separator walls, the upper edge of the separator walls and the edges between the compartment bottom walls and the compartment side walls being arcuately curved.

Figure 1:
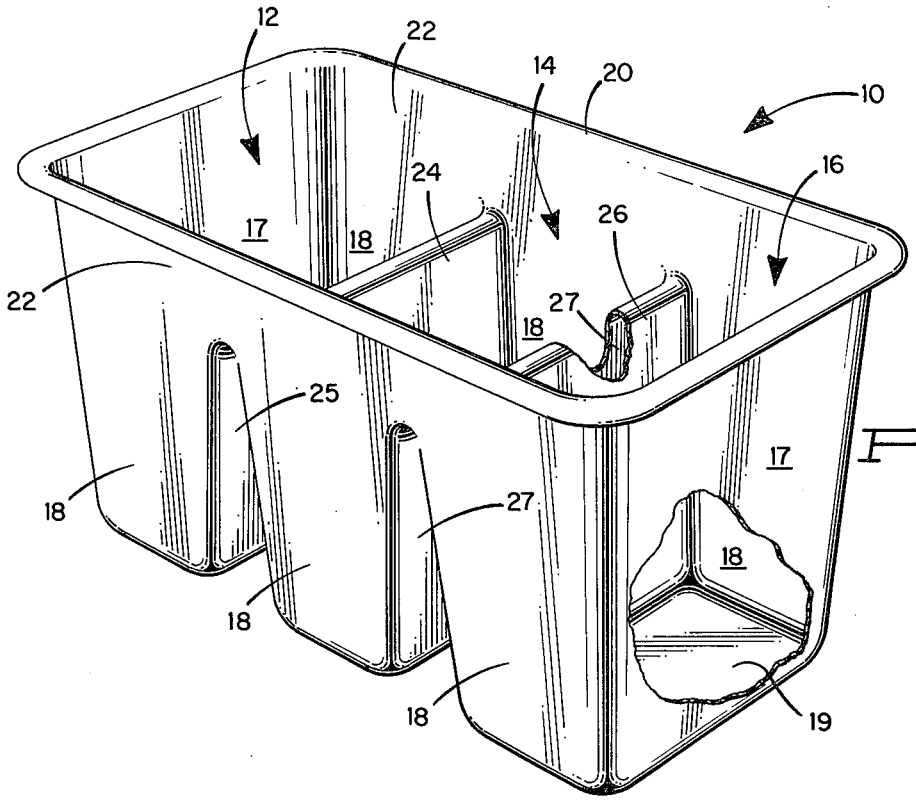
Figure 2:
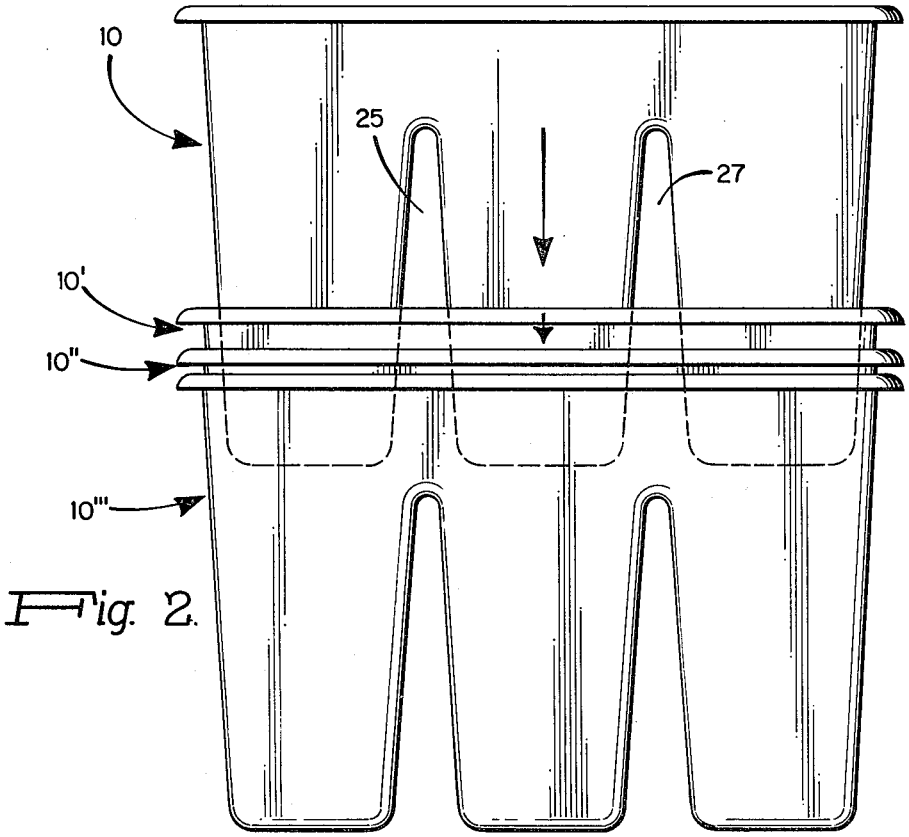

The invention will now be described with reference to the accompanying drawing,

FIG. 1 of which is an isometric view of a preferred embodiment, partly broken away to illustrate details of construction, and FIG. 2 is an end view of the same illustrating the successive close stacking function advantages of the invention.

Referring to the drawing, a generally rectangular container is illustrated at 10 divided into three compartments 12, 14 and 16 by pairs of inverted V-shaped walls 24 and 26 externally bounding downwardly diverging openings 25 and 27, respectively.

In accordance with the present invention, the upper rectangular edge of the multiple container 10 is peripherally bounded by an inwardly overlapping lip 20 which further assists in enabling very close stacking when multiple containers are forced successively within one another and in tighter fashion than illustrated at 10, 10', 10'', 10''' during the commencement of the stacking process shown in FIG. 2.

The long side walls of the container are thus divided into similar trapezoidal bounding side-wall panels 18, with each of the container end walls 17 also tapering inwardly from the upper lip downwardly towards the base 19 at an angle substantially parallel to the taper of the corresponding transverse end wall of the separator wall of the center compartment 14. Thus the left hand trapezoidal downwardly converging outer walls 18 of the end compartments 12 and 16 have shapes that are similar to that of the side walls 18 of the center compartment 14.

Further in accordance with the invention, the height of the separator walls 24 and 26 is made a substantial portion of the total height of the container 10 which, for use with conventional shopping bags and the like may be set at about ¾ the height of the container; and the top edges of the transverse separator walls 24 and 26 are rounded as shown, preferably with a rather wide arc or curvature subtending at least about 100 degrees, and with the angle subtended by the diverging V-shaped spaces 25 and 27 of the order of about 20–25 degrees. These relative dimensions and spaces have been found admirably to solve the important problem of enabling close stacking, particularly when similar arc curvature is provided at the edges between the bottom walls 19 and the side wall 18 and the end walls 17. This construction also enables the overlapping of paper or plastic liner bags within each compartment 12, 14 and 16, including overlapping the adjacent portions of the top lip 20. In addition, this particular construction has been found rather remarkably to solve the molding problem involved in insuring, particularly when injection molded, that the plastic material can set in a sufficiently reasonable time to permit ready withdrawal and immediate stacking without adhereing to adjacent units. It was, indeed, surprising that these relative dimensions introduced sufficient cooling for the masses of materials required while providing the optimum stacking and liner usage functions at the same time. It should be borne in mind that all of this has been found to be consistent with maintaining the structure extremely lightweight and with as thin a wall as is practically feasible. Thicker walls, indeed, will seriously inhibit the meshing function in stacking through the purpose of the invention require a substantial wall thickness, found to be preferably of the orrder of one-eighth inch.

Modifications will occur to those skilled in this art and are considered to fall within the spirit and scope of the invention.

What is claimed is:

1. A multiple-compartment closely stackable wastebasket for separating trash in bags having, in combination, a generally rectangular container consisting of a single piece of molded plastic, said container having trapezoidal end walls and longer trapezoidal side walls, said container being interiorly transversely compartmented by open-ended inverted V-shaped separator walls into three substantially similar substantially trapezoidal-walled compartments of rectangular horizontal cross-section for receiving conventional shopping bags, the separator walls extending transversely between the side walls of the container along the length of the compartments and extending upwardly from the lowermost extremity of the container substantially three-quarters of the height of the container such that the end compartments are provided with transverse end walls of greater height than the intermediate compartment transverse end walls formed by said separator walls, the end walls of each compartment diverging upwardly with substantially the same angle of divergence as the end walls of the other compartments, and the side walls of each compartment diverging upwardly with substantially the same angle of divergence as the side walls of the other compartments, the angle subtended by the V-shaped separator walls being of the order of 20–25 degrees, the compartments having bottom walls constituting the lowermost extremity of the container, the upper edge of the separator walls and the edges between the compartment bottom walls and the compartment side and end walls being arcuately curved, and the container being open at the top and having an upper rectangular edge peripherally bounded by a lip, the wall thickness of the container being of the order of one-eighth inch.

* * * * *